United States Patent [19]

LeMarbe

[11] Patent Number: 4,606,276

[45] Date of Patent: Aug. 19, 1986

[54] MOTION RETARDER

[75] Inventor: Edward S. LeMarbe, Plainfield, Ill.

[73] Assignee: Miner Enterprises, Inc., Geneva, Ill.

[21] Appl. No.: 725,834

[22] Filed: Apr. 22, 1985

[51] Int. Cl.[4] ..... B61D 7/00

[52] U.S. Cl. ..... 105/250; 105/284; 192/8 R

[58] Field of Search ..... 105/255, 282 R, 284, 105/286, 299, 304, 250, 251, 252; 384/219, 273; 188/83, 166, 167; 192/8 R; 222/486, 505

[56] References Cited

U.S. PATENT DOCUMENTS

| | | | |
|---|---|---|---|
| 369,102 | 8/1887 | Davis | 105/282 R |
| 529,932 | 11/1894 | Meier | 188/83 |
| 563,261 | 7/1896 | Davies | 188/83 |
| 1,956,406 | 7/1934 | Caldwell et al. | 188/83 |
| 3,137,247 | 6/1964 | Hamilton et al. | 105/299 |
| 4,296,643 | 10/1981 | Cornelius | 188/83 |
| 4,452,149 | 6/1984 | LeMarbe | 105/282 R |
| 4,452,822 | 6/1984 | Fischer | 105/282 R |

*Primary Examiner*—Robert B. Reeves
*Assistant Examiner*—Dennis C. Rodgers

[57] ABSTRACT

A motion retarder particularly useful for regulating rotary movement of a shaft, for example, includes an inner and outer tension unit carried on a bolt shaped rod. Arcurate end segments of a pressure member of each unit are positioned in an opposing manner to define a pair of shaft holding spaces. A spring carried on the rod between the inner unit and a head portion of the rod may be advanced through a threaded connection between an end of the rod and a lock-type nut forming part of the outer unit. This advancement compresses the spring to force an inner friction surface of the unit pressure member end segments into engagement with an outer surface of a shaft positioned in the respective holding spaces. This engagement selectively inhibits inadvertent shaft movement to maintain the position of the shaft until shaft movement is desired.

2 Claims, 5 Drawing Figures

MOTION RETARDER

BACKGROUND OF THE INVENTION

1. Field of the Invention

This invention relates to devices to regulate movement of a machine part and more particularly to a motion retarder having a surface prepared to frictionally engage the machine part and regulate part movement whether that movement be linear, rotational or both.

2. Prior Art

Use of friction to regulate movement has been known and widely used for many years. For example, an automotive vehicle first uses static friction between its tires and a surface of a road to effect vehicle movement. Once there is movement kinetic friction allows the vehicle to accelerate to a selected rate of travel. Friction is again used to decelerate the vehicle. Braking used to effect deceleration typically includes engagement of a friction member with a brake drum where the kinetic energy from deceleration of the vehicle mass is converted into heat.

Friction also is used by motion retarding devices to regulate other forms of movement. For example, a motion retarder may be used to restrict unwanted lost motion inherent between mechanically linked parts. Additionally, a motion retarder may be used to control positioning of a machine part where externally applied forces may be sufficient in magnitude to effect an unwanted movement of that part. Further uses may include tension control to provide self-adjustment to compensate for wear between joined parts.

SUMMARY OF THE INVENTION

A motion retarder of this invention includes an inner and outer tension unit having spaced end segments. The end segments in turn may be arcuate shaped and positioned in an opposing manner to form holding spaces to receive an outer radiused surface of a shaft, for example. The tension units are carried on a rod which may be in the form of a bolt having one end threaded into a locknut on the outer unit. A spring is positioned between a head portion of the bolt and the inner tension unit. Offsetting the position of the bolt with respect to the holding spaces allows the degree of frictional restraint on a respective shaft to be varied.

During use the retarder may be positioned between a pair of shafts which in turn are disposed in the holding spaces of the retarder. With the shafts so disposed, the tension units are spaced apart. Advancing the bolt through the threaded connection compresses the spring to produce a frictional engagement between a selective portion of the shaft outer surface and the retarder tension unit end segments. This selective engagement produces a static frictional restraint sufficient to prevent shaft movement until the magnitude of force on the shaft exceeds a selected level. Thereafter, shaft movement is retarded by kinetic friction between the retarder tension unit end segments and the shafts.

The motion retarder of this invention provides several advantages over other known devices.

First, this retarder is quite simple and therefore inexpensive to manufacture. The unit end segments, i.e. friction elements, may be in any number of configurations to fit in a complementary manner with the part in motion. Additionally, these friction elements may include specially prepared friction material where more exact regulation or high performance is required.

Secondly, the device may be readily added to or removed from a machine to provide lost motion control or controlled positioning of moving parts of the machine as may be required. The degree of control may be easily and precisely adjusted by rotating the bolt to make minute changes to the effective length of the spring. Thus, the degree of restraint may be readily set or changed. Wear between the engaging surfaces has no significant effect to the degree of restraint once set.

Third, as noted above, the degree of frictional restraint of the respective holding spaces may be made unequal by offsetting the bolt with respect to these spaces. Offsetting may be effected by locating the bolt in apertures which are offset from a center of the tension units or forming the tension units with slotted apertures allowing the bolt to be relocated after the retarder is installed. As offset, one holding space may be used to form a fixed connection with a stationary machine part disposed therein, for example.

Last, the selective engagement of the retarder tension unit end segments and the part surface tends to equalize the static and kinetic frictional restraint to part movement. Initial part movement tends to move the inner and outer units apart to reduce static frictional restraint. Thus, the amount of force needed to start and then needed to continue part movement are not substantially different. The likelihood of travel overrun of the part is thereby reduced.

DESCRIPTION OF THE PREFERRED EMBODIMENT

Figure 3:
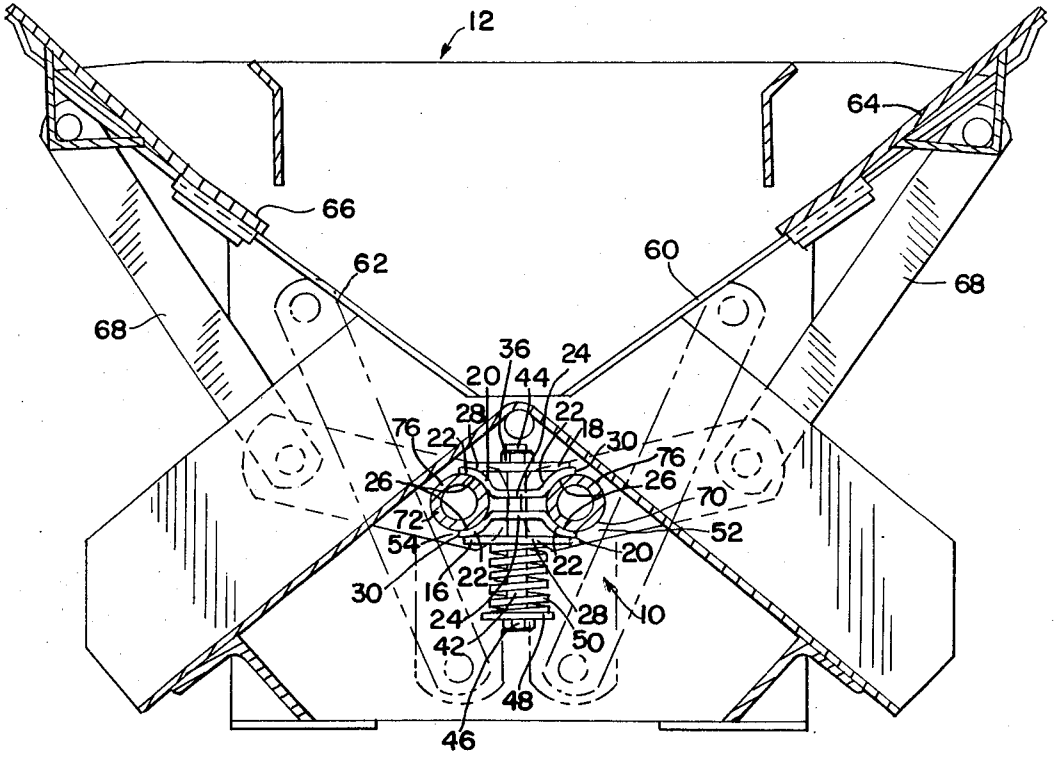
FIG. 3 is a sectional view as seen generally along the line 3—3 of FIG. 2.
Figure 2:
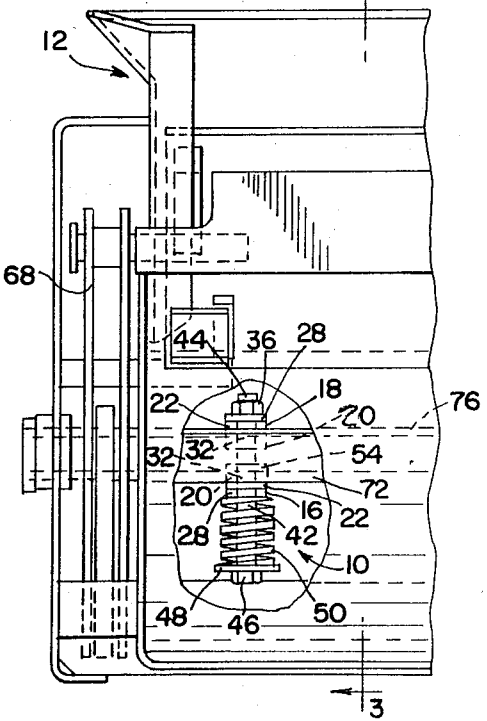
FIG. 2. is a side elevation view of a motion retarder of this invention shown in a cutaway portion as installed in a gate assembly of FIG. 1.

A motion retarder of this invention is shown generally in FIGS. 2 and 3 and designated 10. As shown, the retarder 10 has been installed in a gate assembly 12 forming part of a railroad hopper car 14. It should be understood that this inventive motion retarder 10 may be used with other machines where part movement requires supplemental regulation.

The motion retarder 10 includes an inner and outer tension unit 16,18. Each tension unit 16,18 in turn comprises a pressure member 20 defined by spaced apart arcuate shaped end segments 22 which are connected by a bar portion 24. Each end segment 22 is so formed to have an inner friction surface 26 having a length of approximately 60 degrees. The tension units 16,18 each further include a backing plate 28 joined to outer ends 30 of the pressure member end segments 22.

The pressure member 20 and backing plate 28 of each unit 16,18 are formed with aligned apertures 32. Attached to the backing plate 28 of the outer unit 16 in alignment with the apertures 32 is a lock-type nut 36. Note that in the units 16,18 of the retarder 10 of FIGS.

2,3 the apertures 32 are centrally located in the unit pressure member bar portions 24 and backing plates 28. In a further embodiment of a tension unit set forth in FIGS. 4,5 and designated 40, the apertures 32 are offset to place these apertures 32 closer to one end segment 22 than the other. This aperture offsetting is discussed in greater detail below.

Extending through the inner and outer tension unit apertures 32 is a rod 42 which may be in the form of a bolt having a threaded portion 44 at one end and a head portion 46 at its other end. The threaded portion 44 is secured to the outer unit 18 by the locknut 36. Positioned on the bolt 42 next to the head portion 46 is a washer 48. The bolt 42 also extends through a coil spring 50 such that ends of the spring 50 engage the washer 48 and the backing plate 28 of the inner tension unit 16. As assembled, the arcuate end segments 22 of the inner and outer tension units 16,18 are positioned in an opposing manner to define a pair of holding spaces 52,54.

As noted above, in FIGS. 2 and 3 the motion retarder 10 is shown installed in a gate assembly 12 of a railroad hopper car 14. The structure of this particular gate assembly 12 is set forth in detail in U.S. Pat. No. 4,454,822 and to the extent required is herein incorporated by reference. The gate assembly 12 has an inner and outer discharge opening 60,62 which may be selectively opened or closed by an inner and outer door 64,66 respectively. Ends of each door 64,66 are connected by a set of linkages 68 to an inner and outer door shaft 70,72. As seen in FIGS. 2 and 3, the door shafts 70,72 are positioned respectively in the motion retarder holding spaces 52,54. Attached to an end of each door shaft 70,72 is a bar holder 74 allowing an operator to insert a bar into a holder, swing the bar to rotate a door shaft and effect selective door movement.

With the motion retarder 10 installed as noted, the bolt head portion 46 is rotated to advance the threaded end 44 through the outer unit locknut 36 to compress the spring 50 between the washer 48 and the backing plate 28 of the inner unit 16. Compression of the spring 50 forces the friction surfaces 26 of the tension units 16,18 to engage an outer surface 76 of the door shafts 70,72 respectively. This compressive engagement produces a frictional restraint to shaft movement. Note that the engagement of the outer surface 76 of the shafts 70,72 is selectively limited to two spaced 60 degree portions. As the units 16,18 are spaced apart, these engaged portions of each shaft outer surface 76 are located between the horizontal and vertical axis of each shaft 70,72. The amount of frictional restraint depends on a particular application. The length of the spring 50 is sufficient to allow small incremental changes.

As best understood by viewing FIG. 3, the inner door 64 is opened by rotating the shaft 70 counterclockwise while the outer door 66 is opened by rotating the shaft 72 clockwise. Opposite direction rotation of the shafts 70,72 closes the doors 64,66 respectively. Initial shaft rotation, regardless of the direction, is impeded by static friction between the unit friction surfaces 26 and the shaft outer surfaces 76. Additionally, shaft movement may be inhibited by adhesive rusting of these surfaces 26,78 where the gate assembly 12 has not been used for some time.

The impacting nature of an initially applied force to the shafts 70,72 tends to move the inner and outer units 16,18 apart to further compress the spring 50. During this momentary separation the compressive force on one unit increases while it decreases on the other. The redistribution of forces reduces the overall static frictional restraint between the friction surfaces 26 and respective shafts 70,72. As a result the static frictional restraint is reduced to more closely equal the subsequent kinetic frictional restraint to shaft movement. Thus, initial shaft movement is enhanced while subsequent movement to an overrun position is impeded.

For example, when the outer shaft 72 is rotated clockwise to open the outer door 66, the impacting nature of the force to effect shaft rotation reduces the frictional engagement between the outer unit friction surface 26 and the shaft surface 76. At the same time the frictional engagement between the inner unit friction surface 26 and the shaft surface 76 increases tending to move the inner unit 16 to further compress the spring 50. This momentary effect allows the outer door 66 to be moved initially with less applied force and then to a desired location with a substantially equal force.

With the gate assembly doors 64,66 placed in an open position, ballast may discharge from the hopper car 14 through the gate assemblies 12 to the roadbed below. To discharge a layer of ballast having a particular thickness, the size of the door openings 60,62 is adjusted with respect to the rate of travel of the car 14. Once set it is desirable to inhibit further door movement which would result in a change in the layer thickness. Again, the frictional engagement between the retarder units 16,18 and the door shafts 70,72 inhibits shaft and therefore door movement. Thus, the operator may position himself in a safe location away from the moving car 14. The operator need not walk on the roadbed next to the car 14 with bars positioned in the gate assembly bar holders 74 to maintain a constant flow of ballast.

Note that wear of the unit end segments friction surfaces 26 and door shaft outer surfaces 76 only minimally affects the degree of frictional restraint. The separation of the tension units 16,18 insures continuous shaft engagement, and the spring 50 has a sufficient effective length to be unaffected by this wear. Once set, the motion retarder 10 need not be continuously readjusted.

Figure 1:
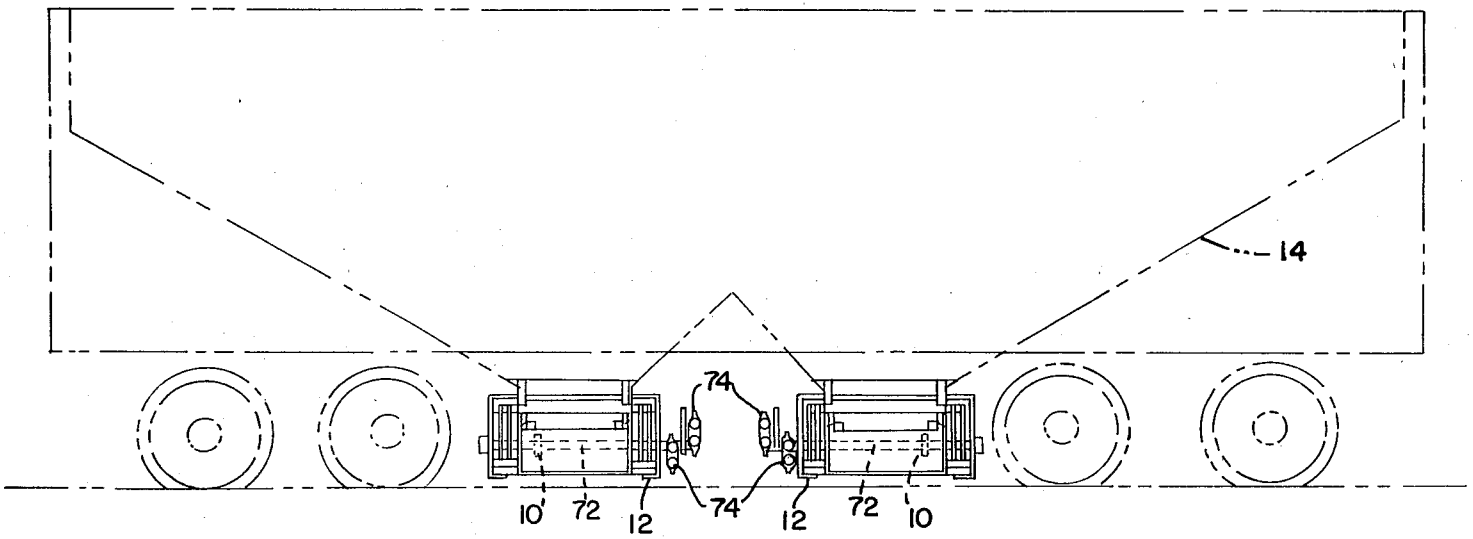
FIG. 1 is a side elevation view of a railroad hopper car installed with gate assemblies for ballast distribution which may include a motion retarder of this invention.
Figure 4:
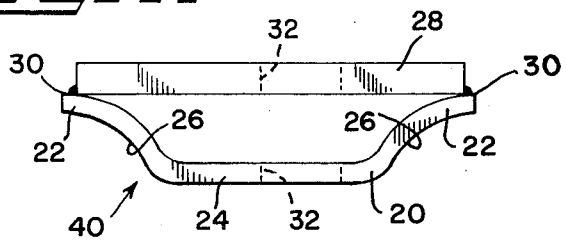
FIG. 4 is a side elevation view of a further embodiment of a tension unit of the motion retarder.
Figure 5:
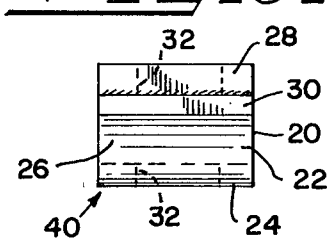
FIG. 5 is an end elevation view of the tension unit of FIG. 4.

When it is desirable to have the motion retarder 10 produce an unequal frictional restraint to part movement, the inner and outer tension units may be formed with their respective apertures 32 in an offset position, see FIG. 4 where the tension unit 40 is shown. Alternately, the apertures 32 may be formed as a slot allowing the position of the bolt 42 to be adjusted after the retarder 10 is installed. The motion retarder 10 installed as seen in FIGS. 2 and 3 with a set of tension units 40 having offset apertures 32 would frictionally restrain movement of the inner shaft 70 to a greater extent than the outer shaft 72. Manufacturing variations between gate assemblies 12 may result in one door being moveable by a force of different magnitude than the other door. The motion retarder 10 having the bolt 42 so located allows an equalizing of the forces required to effect or retard respective door movement.

While embodiments of this invention have been shown and described, it should be understood that the invention is not limited thereto except by the scope of the claims. Various modifications and changes can be made without departing from the scope and spirit of the invention as the same will be understood by those skilled in the art.

What I claim is:

1. In a hopper-type railroad car particularily suited for transporting ballast for selective distribution to a roadbed below said car, said car having gate assemblies to provide regulation of said ballast discharge by selective positioning of doors over outlets in each said gate assembly with said door position being in part controlled by motion retarding means carried by said gate assembly, an improvement of said motion retarding means comprising:

an upright bolt positioned between a pair of door shafts carried by said gate assembly and operatively connected to said doors respectively, an outer tension unit formed with aperture means and threaded locking means aligned with said aperture means to receive a complementarily formed threaded end of said bolt and form a rotational resistant joint therewith, an inner tension unit formed with aperture means with said bolt disposed therein to position said inner tension unit next to said outer tension unit, holding means for respective disposition of said door shafts, said holding means defined by opposing positioned arcuate shaped spaced end segments of a pressure member of said inner and outer tension units respectively with each said end segment having an inner friction surface for engagement with said shaft, said bolt positioned in said tension unit apertures means in closer proximity to one said holding means than said other holding means, and spring means disposed on said bolt between a lower head portion of said bolt and said inner tension unit to move said unit end segment friction surfaces into selective engagement with said shaft with an area of said engagement being limited to an outer surface of said shaft located between an intersection by a vertical axis of said shaft with said shaft surface and a horizontal axis of shaft with said shaft surface, wherein said gate assembly doors may be opened to effect a discharge of said ballast with said position of said doors being in part maintained by engagement of said retarder tension unit end segment friction surfaces with said shaft outer surfaces respectively to inhibit movement of said shafts and insure said discharge remains at a constant rate.

2. In a railroad hopper-type car with motion retarding means as defined by claim 1 and further characterized by, said inner and outer tension unit comprising a pressure member defined by a bar portion connecting with said end segments and a backing plate joined to outer ends of said end segments with said aperture means being an opening in said pressure member bar portion and said backing plate and said unit pressure members being spaced apart by said door shafts carried in said holding means respectively, wherein said spring means may maintain said unit end segment friction surfaces in contact with said shaft surfaces as wear occurs between said friction surfaces and said shaft surface.

* * * * *